US006995782B2

(12) United States Patent
Oda et al.

(10) Patent No.: US 6,995,782 B2
(45) Date of Patent: Feb. 7, 2006

(54) OPTICAL WRITING DEVICE AND IMAGE FORMING APPARATUS

(75) Inventors: Ayumu Oda, Nara (JP); Kyosuke Taka, Nara (JP); Takaharu Motoyama, Kashihara (JP); Nobuo Manabe, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/667,374

(22) Filed: Sep. 23, 2003

(65) Prior Publication Data

US 2004/0056943 A1 Mar. 25, 2004

(30) Foreign Application Priority Data

Sep. 24, 2002 (JP) ..... P2002-277947

(51) Int. Cl.
*B41J 2/385* (2006.01)
*G03G 13/04* (2006.01)

(52) U.S. Cl. ..... 347/138; 347/245; 347/263

(58) Field of Classification Search ..... 347/129, 347/130, 138, 152, 238, 242, 245, 263
See application file for complete search history.

(56) References Cited

U.S. PATENT DOCUMENTS 4,703,334 A * 10/1987 Mochimaru et al. ..... 347/130
5,036,339 A * 7/1991 Hediger ..... 347/242
5,235,348 A * 8/1993 Avonts ..... 347/238
5,274,732 A * 12/1993 Farnand et al. ..... 385/136
6,222,565 B1 * 4/2001 van Os ..... 347/112
6,278,471 B1 * 8/2001 Uchiyama et al. ..... 347/138
6,366,304 B1 * 4/2002 Nakayasu et al. ..... 347/129
6,396,524 B1 * 5/2002 Cooper et al. ..... 347/138

FOREIGN PATENT DOCUMENTS

JP 5-278266 A 10/1993
JP 2003-173073 A 6/2003

* cited by examiner

*Primary Examiner*—Ren Yan
*Assistant Examiner*—Leo T. Hinze
(74) *Attorney, Agent, or Firm*—Birch, Stewart, Kolasch & Birch, LLP

(57) ABSTRACT

This invention provides an optical writing device to be supported at a predetermined position in an image forming apparatus, as well as an image forming apparatus provided with the optical writing device. The optical writing device has a support unit supporting an optical writing head. The support unit includes a first block and a second block supporting one end and the other end of the LED writing head, respectively, and a connecting member interconnecting the first block and the second block while maintaining a positional relationship between the first block and the second block. The connecting member of the support unit is made most easily deformable among the parts constituting the optical writing device.

6 Claims, 9 Drawing Sheets

OPTICAL WRITING DEVICE AND IMAGE FORMING APPARATUS

This Nonprovisional application claims priority under 35 U.S.C. § 119(a) on Patent Application No. 2002-277947 filed in Japan on Sep. 24, 2002, the entire contents of which are hereby incorporated by reference.

BACKGROUND OF THE INVENTION

1. Field of the Invention

The present invention relates to an optical writing device for exposing a surface of an exposure object to light by a plurality of light emitting elements. The present invention also relates to an electrophotographic image forming apparatus.

2. Description of the Related Art

Among electrophotographic image forming apparatuses, a typical image forming apparatus for business use generally utilizes, as an exposure device, an optical writing device which includes light emitting elements, such as LEDs or Els, aligned in an array for downsizing, noise reduction, and power saving.

The use of such an optical writing device provided with light emitting elements aligned in an array can shorten the light path of the optical system to make the device compact and can eliminate a rotating mechanism for noise reduction.

However, an optical writing device for A3 width with a resolution of 600 dpi for example has as many as about 7,000 light emitting elements arranged in one line and hence is constructed to guide light rays emitted from the respective light emitting elements to a photosensitive member through a lens array of selfoc lenses for example. Therefore, the light path is extremely short so that the depth of focus is shallow, which causes a disadvantage that focal shift is likely to occur.

Some of conventional image forming apparatuses have a countermeasure against such focal shift to realize accurate focusing. For example, an image forming apparatus disclosed in Japan Patent Laid-open Publication No. H5-278266 is provided with an adjustment mechanism for adjusting the distance between an optical writing head and a photosensitive member. In this image forming apparatus, the distance between the optical writing head and the photosensitive member is adjusted to provide the sharpest focus by manipulating the adjustment mechanism utilizing a jig inserted in the image forming apparatus or by manipulating the adjustment mechanism while monitoring the results of image forming processing actually performed.

However, the prior art technique described above is based on the premise that the space for mounting a support unit for positioning the writing head relative to the image carrier is defined properly in the image forming apparatus.

For this reason, even if the positioning of the writing head is made before the mounting thereof to the image forming apparatus, the entire support unit as mounted to the image forming apparatus may be deformed due to an external force exerted from the image forming apparatus. In such a case, proper positioning of the writing head needs to be made again after the writing head is mounted to the image forming apparatus.

When the support unit is entirely deformed irregularly with the optical writing device in the state mounted to the image forming apparatus, it is extremely difficult to properly adjust the position of the writing head relative to the image carrier. Accordingly, an intended electrostatic latent image cannot be formed on a surface of the image carrier, which hinders proper image forming processing.

SUMMARY OF THE INVENTION

It is, therefore, an object of the present invention to provide an optical writing device which is capable of holding an optical writing head in an optimal position even when the optical writing device does not fit in a space defined in an image forming apparatus for mounting the optical mounting apparatus, as well as to provide an image forming apparatus provided with such an optical writing device.

An optical writing device according to the present invention comprises a writing head, a first support member, a second support member, and a connecting member. The writing head has longitudinally opposite ends supported by the first support member and the second support member, respectively. The connecting member connects the first support member and the second support member to each other. Thus, the first support member, the second support member and the connecting member constitute a support unit supporting the writing head.

Among the parts constituting the support unit, the connecting member is made more easily deformable than any one of the writing head, the first support member, and the second support member. The material and configuration of the connecting member are so designed that the connecting member becomes easily deformable.

Thus, upon receiving an external force, the connecting member is deformed first in the support unit. Therefore, even when the optical writing device does not fit in an internal space of the image forming apparatus, it is possible to prevent a large force from working on the first and the second support members supporting the writing head at a predetermined position, hence, on the writing head itself.

The foregoing and other objects, features and attendant advantages of the present invention will become more apparent from the reading of the following detailed description of the invention in conjunction with the accompanying drawings.

DETAILED DESCRIPTION OF THE PRESENT INVENTION

Hereinafter, a digital image forming apparatus provided with an optical writing device as an embodiment of the present invention will be described with reference to the drawings. It is to be noted that the term "recording sheet(s)" used in the description given below should be understood to include various kinds of sheet material, recording paper, transfer paper and the like.

Figure 1:
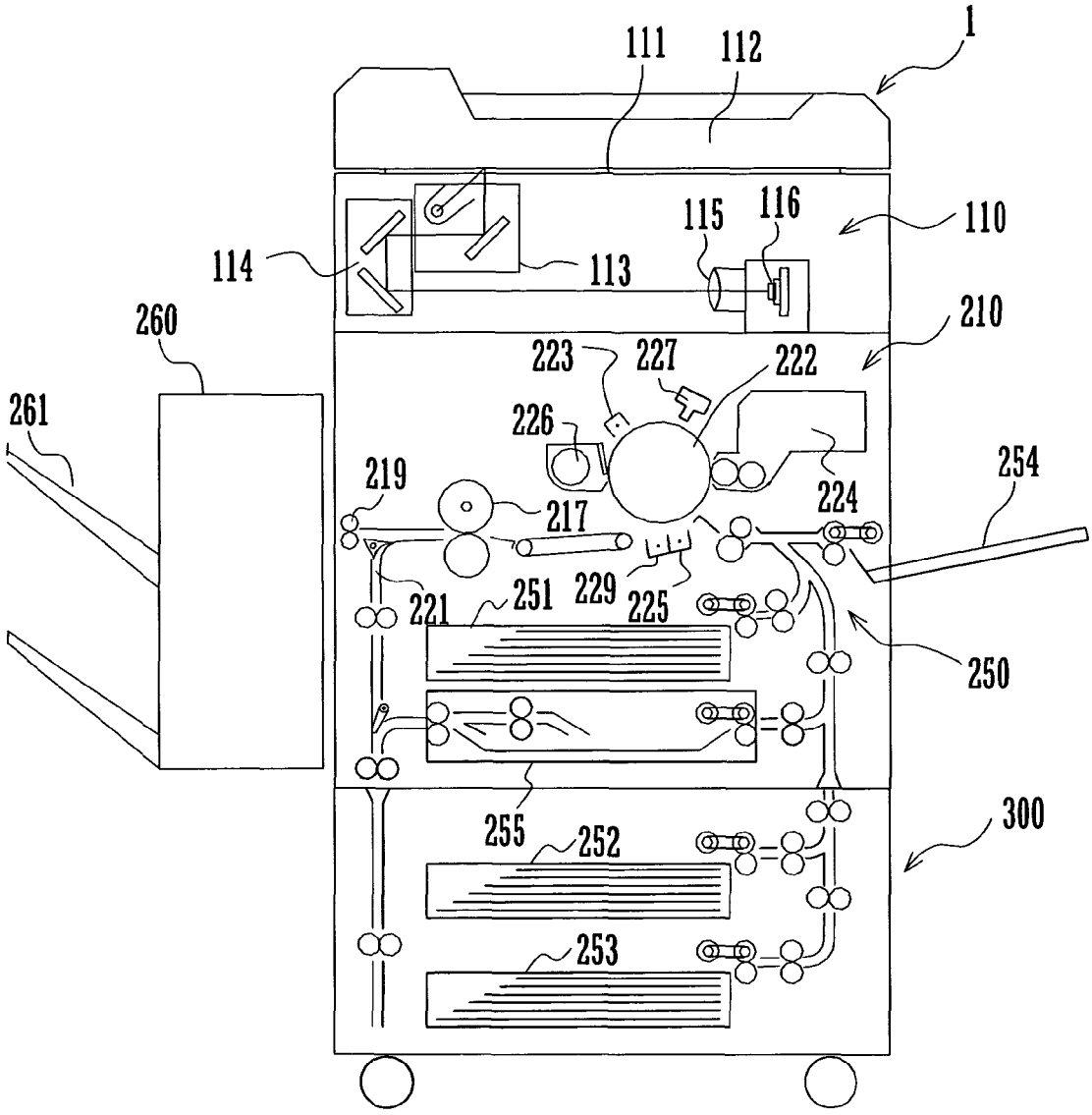
FIG. 1 is a view illustrating the construction of a digital image forming apparatus according to the present invention.

FIG. 1 schematically illustrates the construction of a digital image forming apparatus 1 provided with an optical writing device according to the present invention. As shown in the figure, the digital image forming apparatus 1 includes a document reading section 110, an image forming section 210, a multi-tier sheet feeding desk 300, and a post-processing unit 260.

The document reading section 110 comprises a platen 111 made of transparent glass, an automatic document feeder 112 disposed above the document reading section 110, and an optical system unit for reading an image on an original document placed on the platen 111.

The automatic document feeder 112 operates to feed a plurality of documents set on a document set tray to the platen 111 one by one. The optical system unit, which is disposed below the platen 111, operates to scan the document placed on the platen 111 to read the image thereof. The optical system unit includes a first scanning unit 113, a second scanning unit 114, an optical lens 115, and a CCD line sensor 116, which is a photoelectric converter.

The first scanning unit 113 includes an exposure lamp unit for exposing the document surface to light, a first mirror for reflecting a reflected light image from the document toward a predetermined direction, and so on. The second scanning unit 114 includes a second mirror and a third mirror for guiding the reflected light from the document having been reflected by the first mirror to the CCD line sensor 116. The optical lens 115 causes the reflected light from the document to form an image on the CCD line sensor 116.

In cooperation with the operation of the automatic document feeder 112, the document reading section 110 reads the image on an original document automatically fed by the automatic document feeder 112 at a predetermined image reading position. The image on the document read by the document reading section 110 is transmitted to a non-illustrated image data inputting section as image data, and the image data thus inputted is subjected to predetermined image processing and then temporarily stored in a memory of an image processing unit.

The image data stored in the memory is read out in accordance with an instruction to output and transmitted to an optical writing device 227 included in the image forming section 210, the optical writing device 227 comprising an LED writing head of a solid-state scanning system and the like, as will be described later.

Below the image forming section 210 are disposed a manual feed tray 254, a paper cassette 251, and a duplex unit 255. Further below the image forming section 210 is disposed the multi-tier sheet feeding desk 300 including paper cassettes 252 and 253.

A sheet feeding path is defined to extend from each of the paper cassettes 251 to 253 and or from the manual feed tray 254 to the post-processing unit 260 through an image forming position to be described later. A recording sheet fed from each of the paper cassettes 251 to 253, from the manual feed tray 254 or from the duplex unit 255 is conveyed to the image forming section 210 by means of a conveyor unit 250 including a conveyor roller.

The duplex unit 255, which is connected to a switch back path 221 adapted to reverse recording sheets, is used in forming images on both sides of a recording sheet. It is to be noted that the duplex unit 255 is so structured that it can be exchanged with a normal paper cassette. Thus, the duplex unit 255 can be replaced with a normal paper cassette.

The image forming section 210 includes an image forming unit, a fixing unit 217 and sheet ejecting rollers 219, which are arranged along the sheet feeding path from the upstream side toward the downstream side in the mentioned order. The image forming unit includes a photosensitive drum 222 as an image carrier, the optical writing device 227 as an exposing device, an electrostatic charger 223 for charging the photosensitive drum to a predetermined potential, a developing unit 224 for developing an electrostatic latent image formed on the photosensitive drum 222 into a tangible image by supplying toner to the electrostatic latent image, an image transfer device 225 of the charger type for transferring the toner image formed on a surface of the photosensitive drum 222 onto a recording sheet, a static eliminator 229 for eliminating static charge from the recording sheet to allow the recording sheet to be easily released from the image carrier 222, and a cleaner 226 for recovering excess toner.

A charging process, an exposure process, a developing process, an image transfer process, and a cleaning process are performed around the photosensitive drum 222 by the electrostatic charger 223, optical writing device 227, developing unit 224, image transfer device 225, static eliminator 229, and cleaner 226. At the image forming position between the photosensitive drum 222 and the image transfer device 225, an unfixed developer image formed based on image data is transferred to a surface of the recording sheet. Thereafter, the recording sheet is guided to the fixing unit 217 located downstream of the image forming position in the sheet feeding path. The fixing unit 217 applies heat and pressure to the unfixed developer image on the recording sheet, thereby fixing the developer image onto the recording sheet.

The sheet feeding path is branched into two directions at a location downstream of the fixing unit 217, one being connected to the switch back path 221 for reversing the advancing direction of the recording sheet to form an image also on the reverse side of the recording sheet, the other being connected to the post processing unit 260 for performing post-processing such as stapling for the recording sheet on which an image has been formed and ejecting the recording sheet to an elevator tray 261. It is to be noted that although a monochromatic image forming apparatus is described in this embodiment, the advantages of the present invention can be obtained also in the case of a multicolor image forming apparatus.

Figure 2:
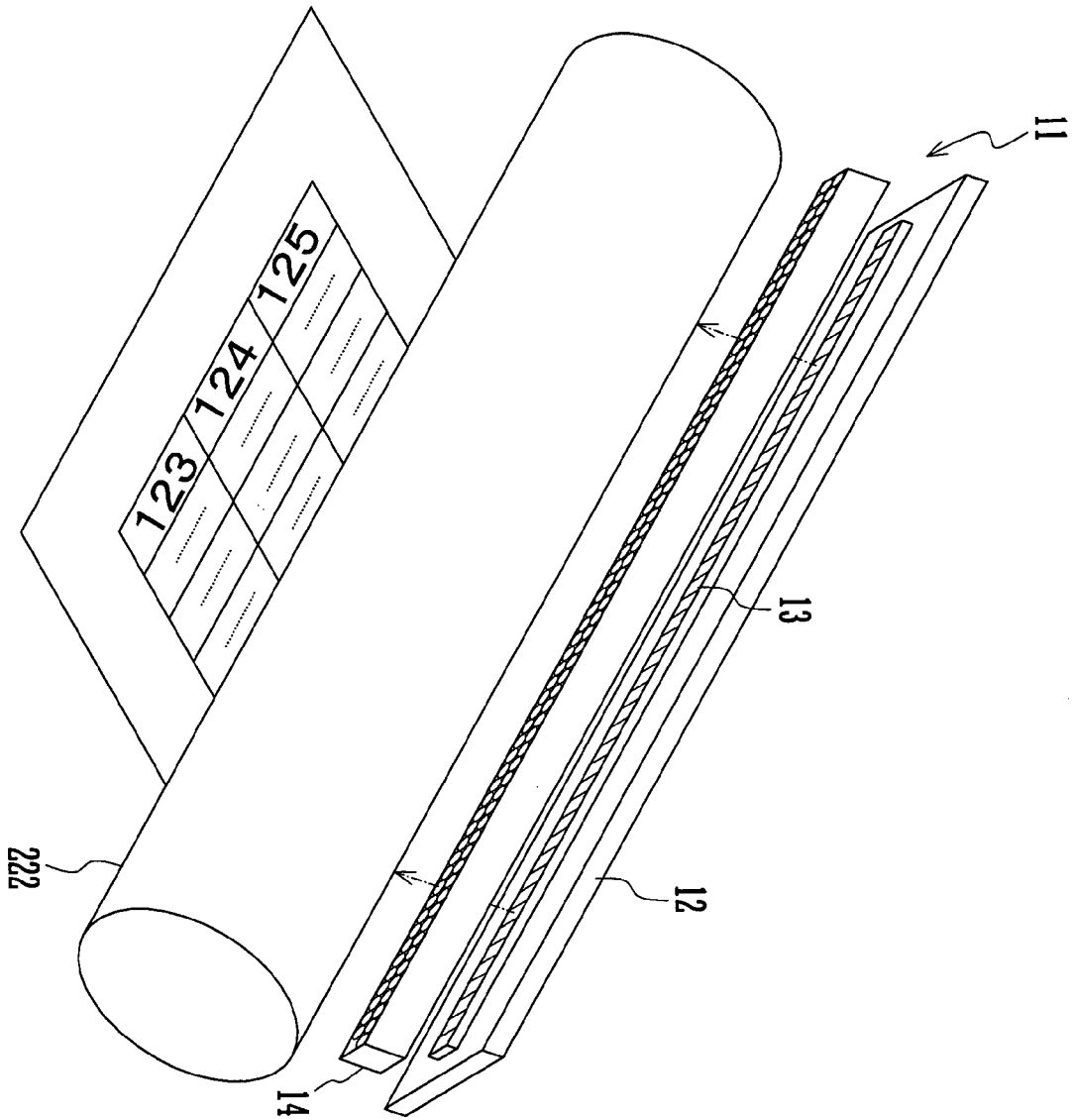
FIG. 2 is a view illustrating the construction of a portion of the digital image forming apparatus adjacent an optical writing device according to the present invention.

FIG. 2 is a view illustrating the construction of the optical writing device 227. Specifically, FIG. 2 schematically illustrates the structure of the LED writing head 11 of the optical writing device 227 in relation to the photosensitive drum 222. As shown in the figure, the LED writing head 11 comprises an LED array substrate 12 mounting LEDs 13 thereon, a lens array 14, and the like. The LEDs 13 emit light in accordance with image data read out of the memory or image data transmitted from an external device, thus serving as a light source for exposing the photosensitive drum 222 to light. The lens array 14, which comprises selfoc lenses for example, condenses light emitted from the LEDs 13 to form an image on the photosensitive drum 222. Although the LED writing head is used as the writing head in this embodiment, the present invention is not limited thereto and may employ an EL writing head using Els or a like writing head.

Figure 3:
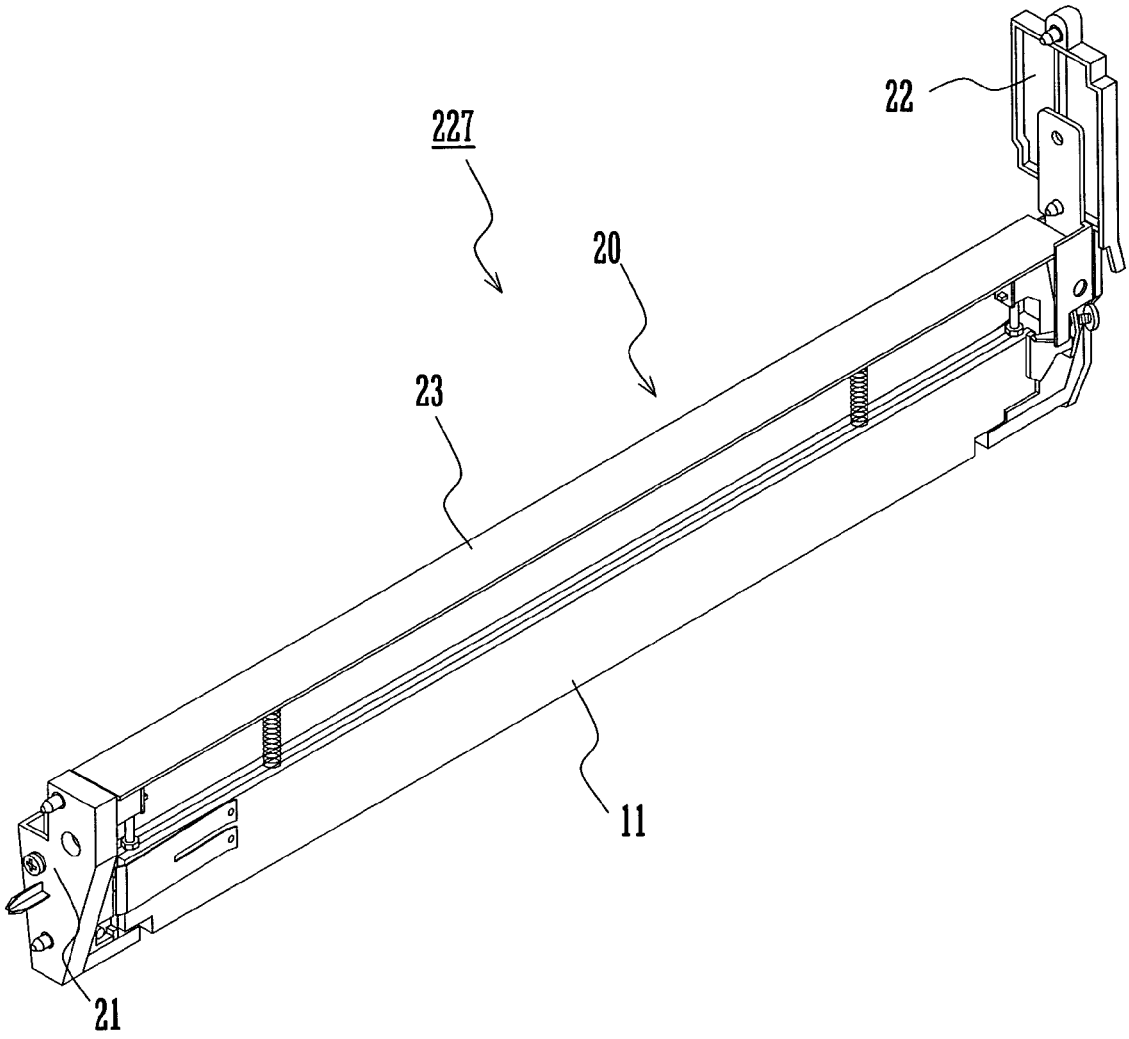
FIG. 3 is a perspective view illustrating the construction of the optical writing device according to the present invention.

FIG. 3 is a perspective view schematically illustrating the construction of the optical writing device 227. As shown in the figure, in addition to the LED writing head 11, the optical writing device 227 includes a support unit 20 supporting the LED writing head 11. The support unit 20 includes a first block 21, a second block 22, and a connecting member 23 for interconnecting the first block 21 and the second block 22.

In this embodiment, the first block 21 and the second block 22 are molded from a base material comprising a glass-fiber-reinforced resin such as PPS (polyphenylene sulfide) or PPE (polyphenylene ether) using a mold. The material of the first and second blocks 21 and 22 has a high strength and a low coefficient of linear expansion for realizing highly accurate positioning of the LED writing head 11. In this embodiment, the first block 21 constitutes the first support member defined by the present invention, while the second block 22 constitutes the second support member defined by the present invention.

When inserted into the digital image forming apparatus 1, the second block 22 is located on a front side of the digital image forming apparatus 1, where toner cartridge exchange or maintenance operation is performed. Since the shape of the second block 22 is restricted for ensuring smooth processing of the operation, the second block 22 may be shaped to be susceptible to deformation.

For this reason, the second block 22 is formed of PPS which has a low coefficient of linear expansion and a high strength. Although the first block 21 and the second block 22 are formed of resin in view of the cost and productivity in this embodiment, these members may be made of diecast aluminum or the like if importance is attached to the strength thereof.

The connecting member 23 interconnecting the first block 21 and the second block 22 is formed by working a thin steel sheet with a press. In this embodiment, the connecting member 23 is formed of a steel sheet having a thickness of 0.6 mm. However, the thickness and material of the connecting member 23 are not limited to this embodiment. Specifically, the connecting member 23 may be formed of any material and may have any configuration as desired on condition that the connecting member 23 can be deformed more easily than any one of the first block 21, the second block 22 and the LED writing head 11.

In the present invention the connecting member 23 is so constructed as to be most easily deformable in the optical writing device 227. The "easily deformable", as used herein, means that the connecting member 23 can be deformed easily by an external force because the connecting member 23 is formed of a material having a low modulus of elasticity or shaped to have a small geometrical moment of inertia, or for a like reason. The deformation of the connecting member 23 is not necessarily based on elastic deformation but plastic deformation which occurs quickly due to an external force. However, it is not preferable to form the connecting member 23 using a material which makes the connecting member 23 susceptible to brittle fracture.

The support unit 20 supports one end of the LED writing head 11 by the first block 21 and the other end of the LED writing head by the second block 22. The first block 21 and the second block 22 are secured at respective predetermined positions in the image forming apparatus 1 by an insertion guide and the like.

Figure 4:
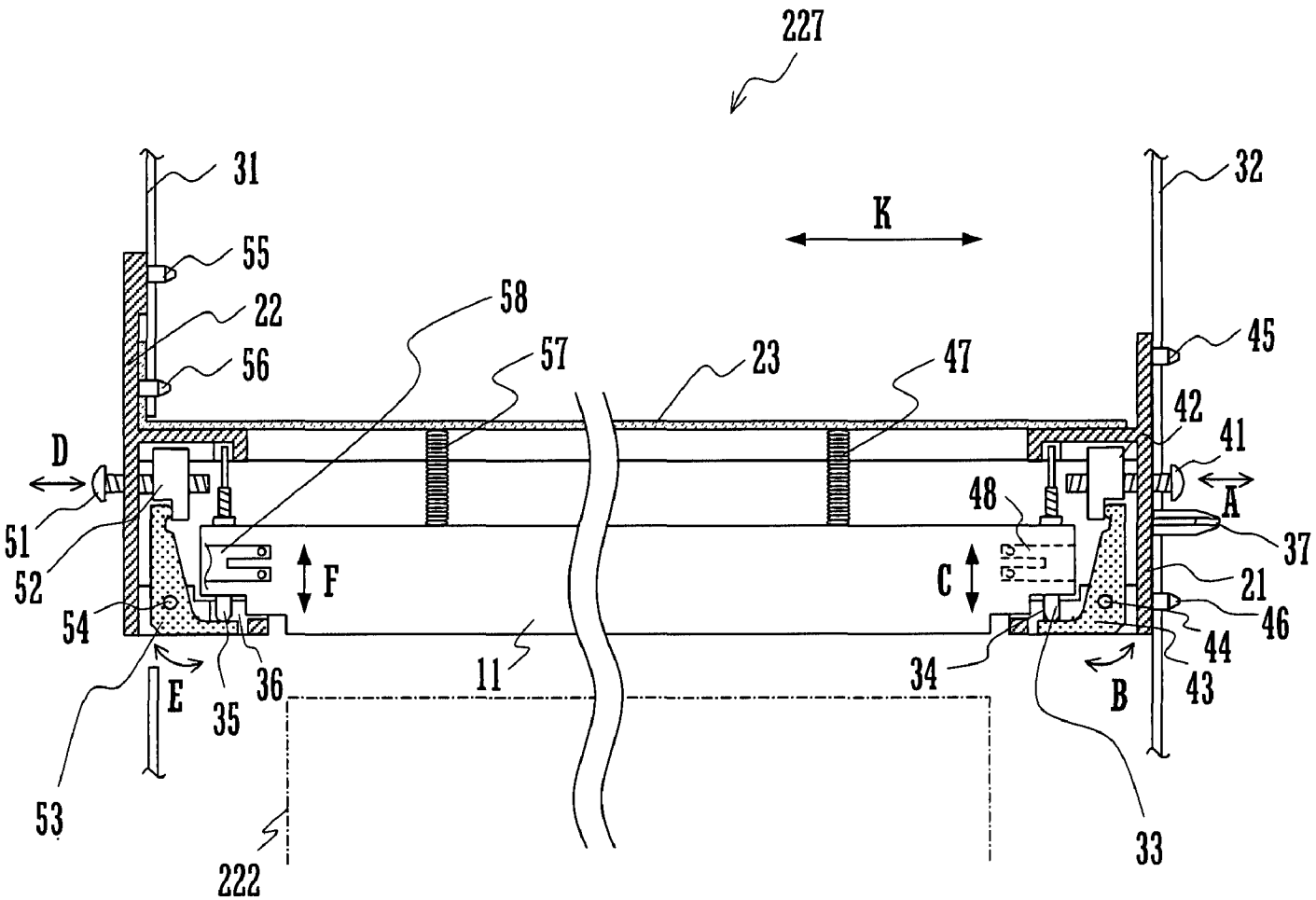
FIG. 4 is a sectional view illustrating the construction of the optical writing device according to the present invention.
Figure 5:
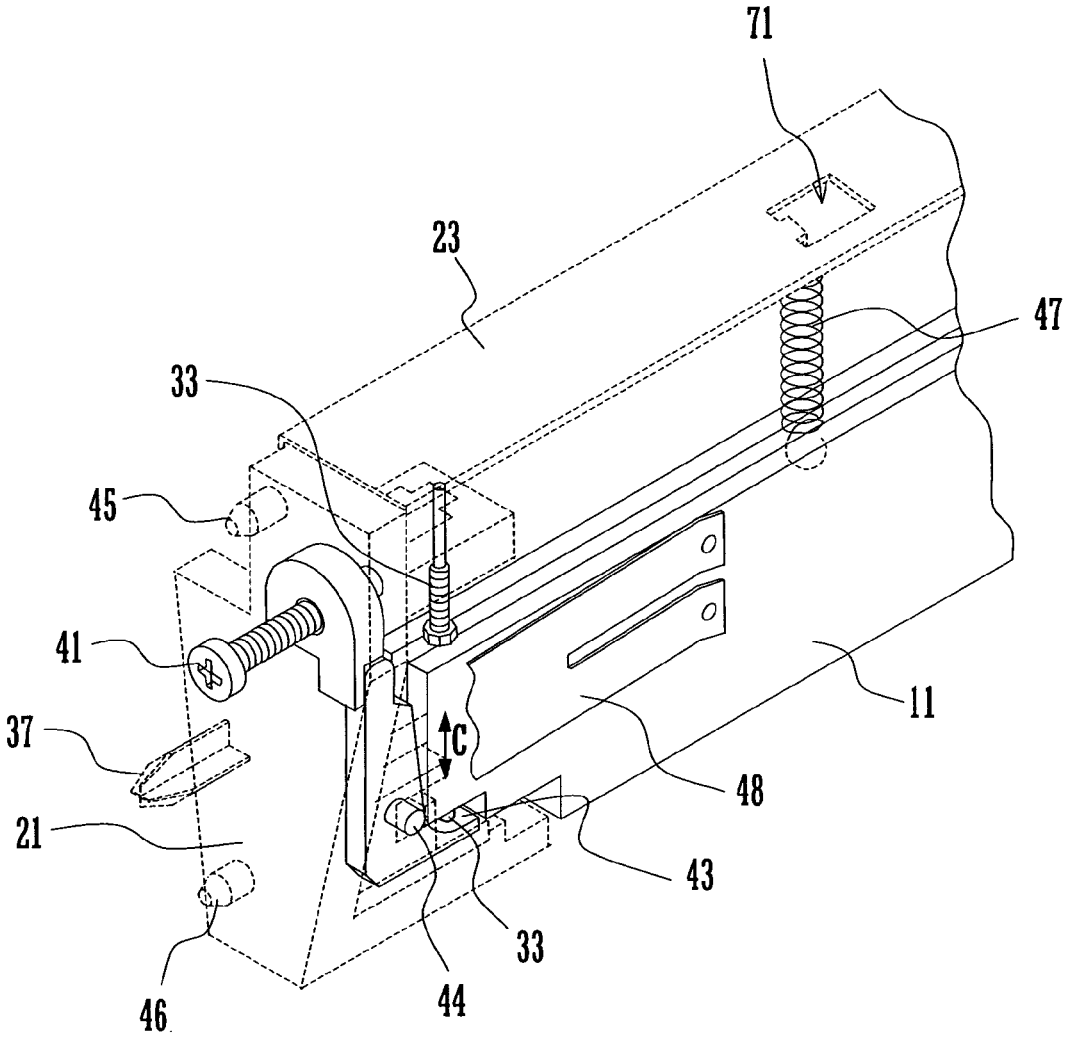
FIG. 5 is a view illustrating the structure of a first support member according to the present invention.
Figure 6:
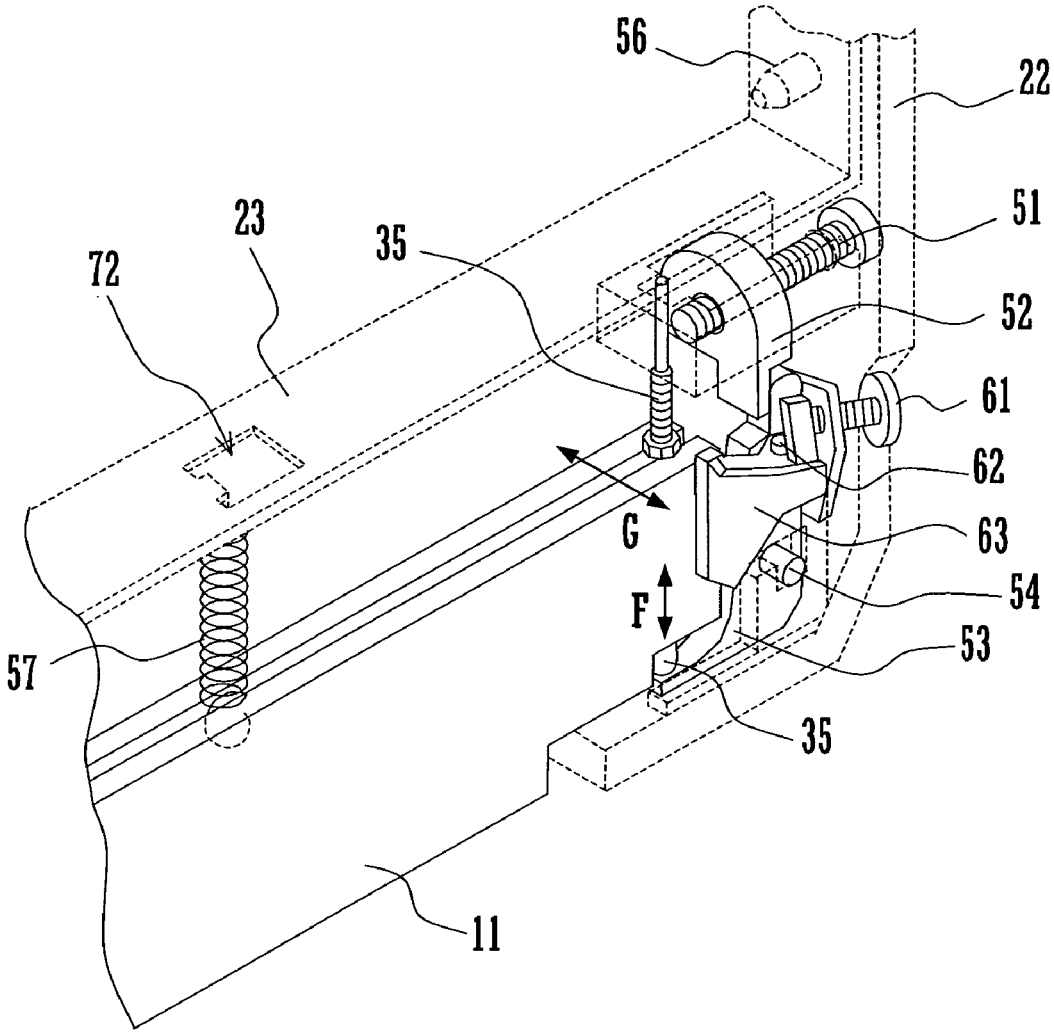
FIG. 6 is a view illustrating the structure of a second support member according to the present invention.

FIG. 4 is a sectional view illustrating the construction of the optical writing device 227. In the figure, the direction to the right and left is the primary scanning direction, whereas the direction perpendicular to the drawing sheet surface is the sheet feeding direction. Therefore, the near side in the figure is the upstream side in the sheet feeding direction, whereas the far side in the figure is the downstream side in the sheet feeding direction. FIG. 5 illustrates the structure of the first block 21 of the optical writing device 227, while FIG. 6 illustrates the structure of the second block 22 of the optical writing device 227.

The first block 21 includes, as position adjustment members, an adjusting screw 41, a slide member 42 which slides in the arrow A direction in FIG. 4 with rotation of the adjusting screw 41, and a first adjustment member 43 constantly abutting a portion of the slide member 42 for turning in the arrow B direction about a rotating shaft 44 in accordance with displacement of the slide member 42 in the arrow A direction.

When the first adjustment member 43 turns in the arrow B direction, the LED writing head 11 is displaced in the arrow C direction within the optical writing device 227. The first block 21 is provided with a fixing member 45 and a fixing member 46 as positioning members. The first block 21 is further provided with a resilient member 48 for biasing the LED writing head 11 toward the upstream side in the sheet feeding direction.

The second block 22 includes, as position adjustment members, an adjusting screw 51, a slide member 52 which slides in the arrow D direction in FIG. 4 with rotation of the adjusting screw 51, and a second adjustment member 53 which turns in the arrow E direction about a rotating shaft 54 in accordance with the movement of the slide member 52. When the second adjustment member 53 turns in the arrow E direction in FIG. 4, the LED writing head 11 is displaced in the arrow F direction in FIG. 4 within the optical writing device 227.

The second block 22 is provided with a fixing member 55 and a fixing member 56 as positioning members. The second block 22 is further provided with a resilient member 58 for biasing the LED writing head 11 toward the downstream side in the sheet feeding direction. The resilient member 48 and the resilient member 58 bias the LED writing head 11 in opposite directions. Therefore, the LED writing head 11 can be inserted or withdrawn by detaching only one of the resilient member 48 of the first block and the resilient member 58 of the second block without the need to detach both of the resilient members 48 and 58.

As shown in FIG. 6, the second block 22 further includes an adjusting screw 61 and a third adjustment member 63 which turns about a rotating shaft 62 with rotation of the adjusting screw 61, as position adjustment members for moving the LED writing head 11 in the arrow G direction. In this embodiment, the above-described adjusting screws 41, 51, and 61 constitute the manipulation members defined by the present invention.

Figure 7:
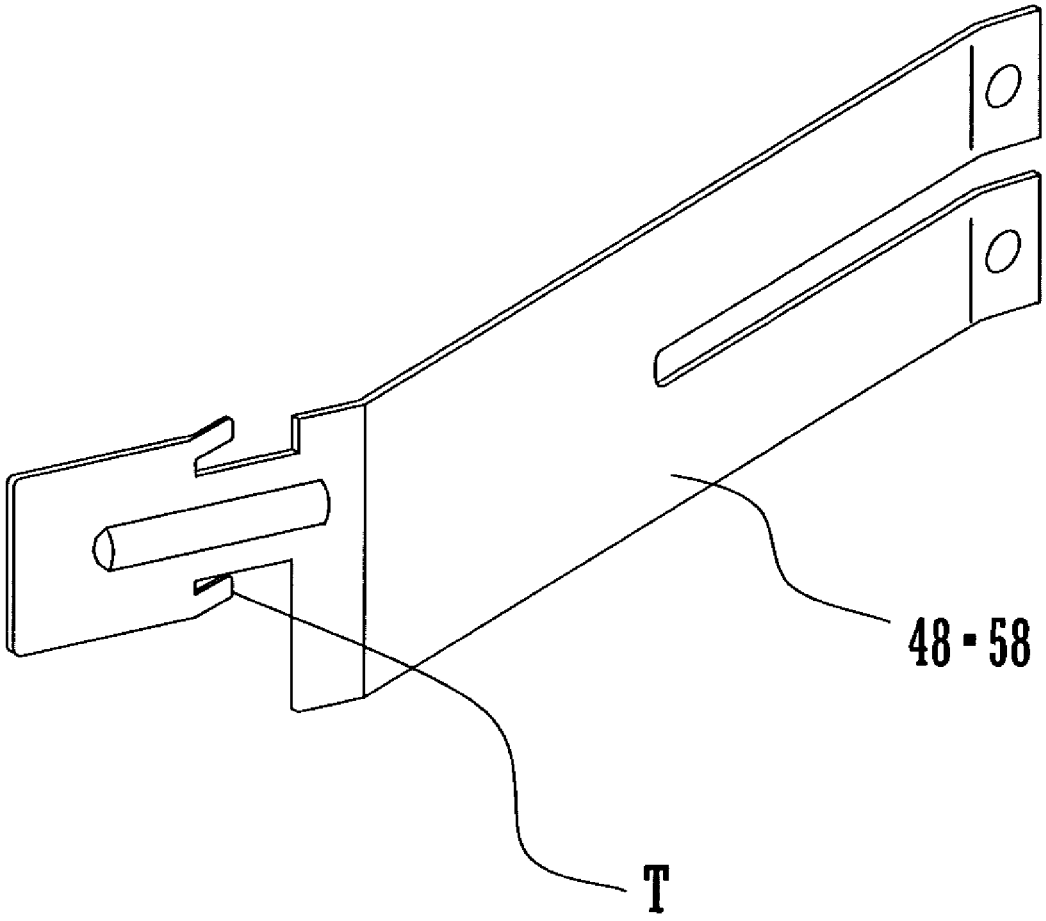
FIG. 7 is a view illustrating an example of resilient member used in the optical writing device according to the present invention.

As shown in FIG. 7, each of the resilient member 48 and the resilient member 58 may comprise a leaf spring made of a stainless spring steel sheet, for example. As shown in the figure, each of the resilient members has a stopper portion T to be inserted into a mounting hole of the first block 21 or the second block 22, thereby biasing the LED writing head 11 in the sheet feeding direction or in the opposite direction. Upon insertion into the mounting hole, the leaf spring is reliably secured so as not to come out unintentionally but can be withdrawn if desired.

As described above, since the resilient members 48 and 58 are fitted on opposite sides of the LED writing head 11, the LED writing head 11 can be easily detached from the support unit 20 by removing only the resilient member 58 mounted to the second block 22. Although a leaf spring made of a stainless spring steel sheet is used for each of the resilient members in this embodiment, use may be made of a leaf spring made of another spring material, a compression coil spring or a helical torsion spring. However, in order to make the device compact, it is preferable to use a leaf spring as in this embodiment.

Further, the connecting member 23 is provided with resilient members 47 and 57 for respectively biasing the first adjustment member 43 and the second adjustment member 53 toward the photosensitive drum 222. In this embodiment, the resilient members 47 and 57 each comprise a compression spring manufactured using a wire having spring characteristics such as a stainless spring steel wire. The connecting member 23 is formed with bent portions 71 and 72 each fitted in one end of the relevant resilient member 47 or 57. Each of the resilient members 47 and 57 has the other end at which approximately one turn of the coil is bent about 90 degrees for fitting into a groove formed in the LED writing head 11. With such a feature, the resilient member 47 and the resilient member 57 are prevented from being inadvertently detached from the LED writing head 11. However, when the LED writing head 11 needs to be detached, the resilient member 47 and the resilient member 57 can be easily disengaged from the groove. Although a compression coil spring is used for each of the resilient members 47 and 57 in this embodiment, use may be made of a leaf spring or a helical torsion spring.

The LED writing head 11 has opposite ends respectively provided with posts 33 and 35, which are supported on the support unit 20. On the first block 21 side, the tip end of the post 33 is brought into engagement with the first adjustment member 43 for adjusting the distance between the LED writing head 11 and the photosensitive drum 222. The engagement between the first adjustment member 43 and the post 33 also functions to position the LED writing head 11 in the primary scanning direction K (i.e. the axial direction of the photosensitive drum 222). Specifically, the movement of the LED writing head 11 in the primary scanning direction K is restricted by the fitting of the post 33 into a hole formed in the first block 21. On the second block 22 side, the tip end of the post 35 is brought into engagement with the second adjustment member 53 for adjusting the distance between the LED writing head 11 and the photosensitive drum 222. The tip ends of the posts 33 and 35 engaging the first and the second adjustment members 43 and 53, respectively, are made spherical so that: the posts 33 and 35 can smoothly slide relative to the first and the second adjustment members 43 and 53 for enabling smooth assembling or adjusting; and each post and the relevant adjustment member contacts at one point for preventing deviation of the contact point after it is appropriately adjusted, thereby stabilizing the assembling and adjusting operations.

Next, the method of focus adjustment in the optical writing device 227 will be described. Preferably, the optical writing device 227 is subjected to various adjustments such as focus adjustment and inclination adjustment utilizing a suitable adjustment mechanism before the writing device 227 is mounted to the digital image forming apparatus 1, which makes the adjustments efficient and accurate. Specifically, such adjustments are achieved by changing the position of the LED writing head 11 mounted to the adjustment mechanism. In changing the position of the LED writing head 11 the adjusting screws 41, 51, and 61 of the first and second blocks 21 and 22 are used. As shown in FIGS. 4, 5, and 6, the LED writing head 11 can be moved in each of the arrow C direction, arrow F direction and arrow G direction by appropriately rotating each of the adjusting screws 41, 51, and 61. The change of the position of the LED writing head 11 can also be achieved in a state where the writing head 11 is mounted to the optical writing device 227.

Figure 8:
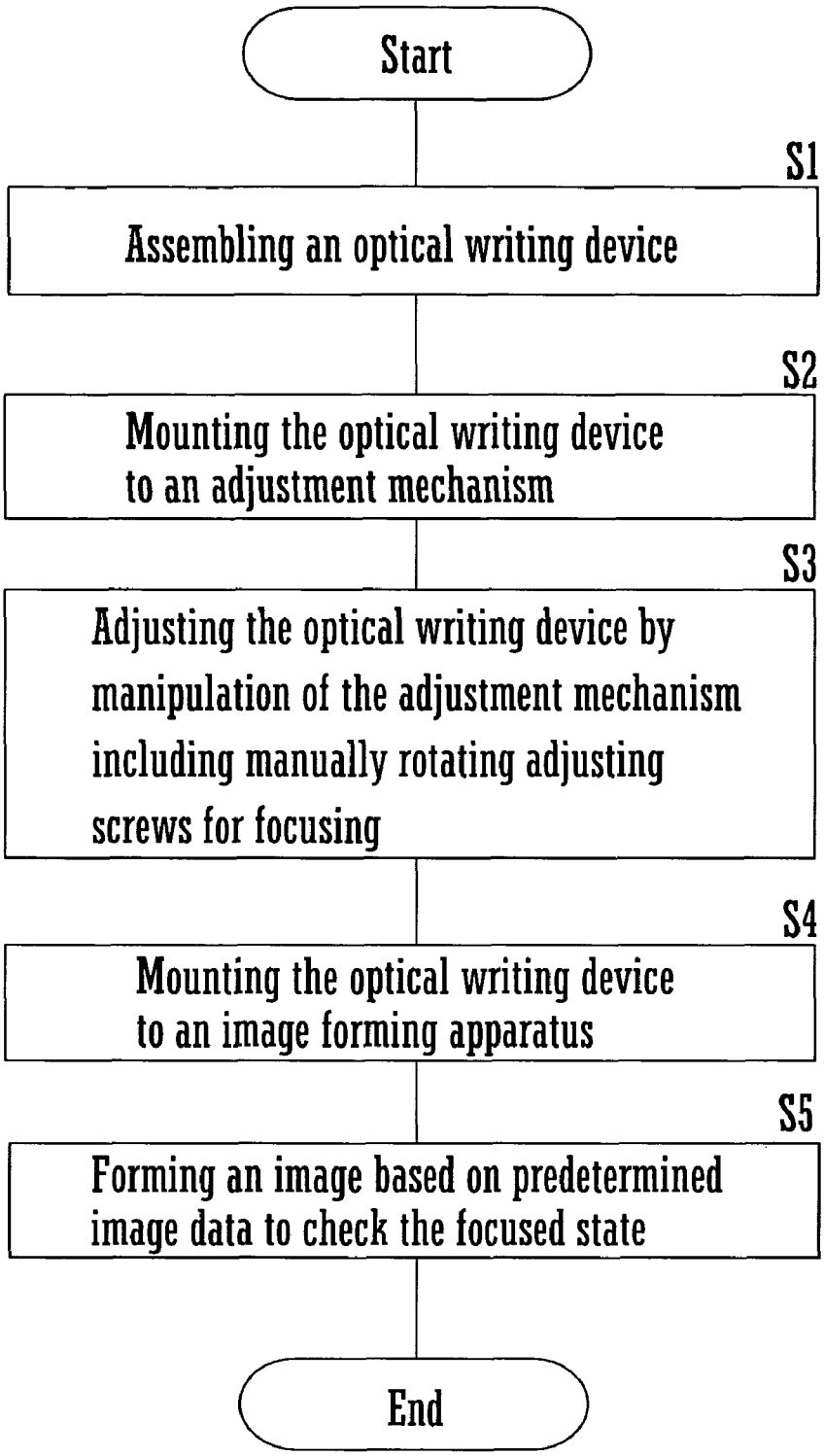
FIG. 8 is a flowchart of an exemplary focus adjustment process for the optical writing device.

The flowchart of FIG. 8 shows an example of such adjustment process. First, optical writing device 227 of the above-described construction is assembled (S1). Subsequently, the optical writing device 227 is mounted to the adjustment mechanism (S2). Then, the optical writing device 227 is adjusted by manipulation of the adjustment mechanism including manually rotating the adjusting screws 41, 51, and 61 for focusing (S3). After the adjustment using the adjustment mechanism, the optical writing device 227 is mounted to the digital image forming apparatus 1 (S4). Thereafter, image formation based on predetermined image data is performed to check the focused state (S5). Efficient and accurate focus adjustment can be achieved through these process steps.

Figure 9:
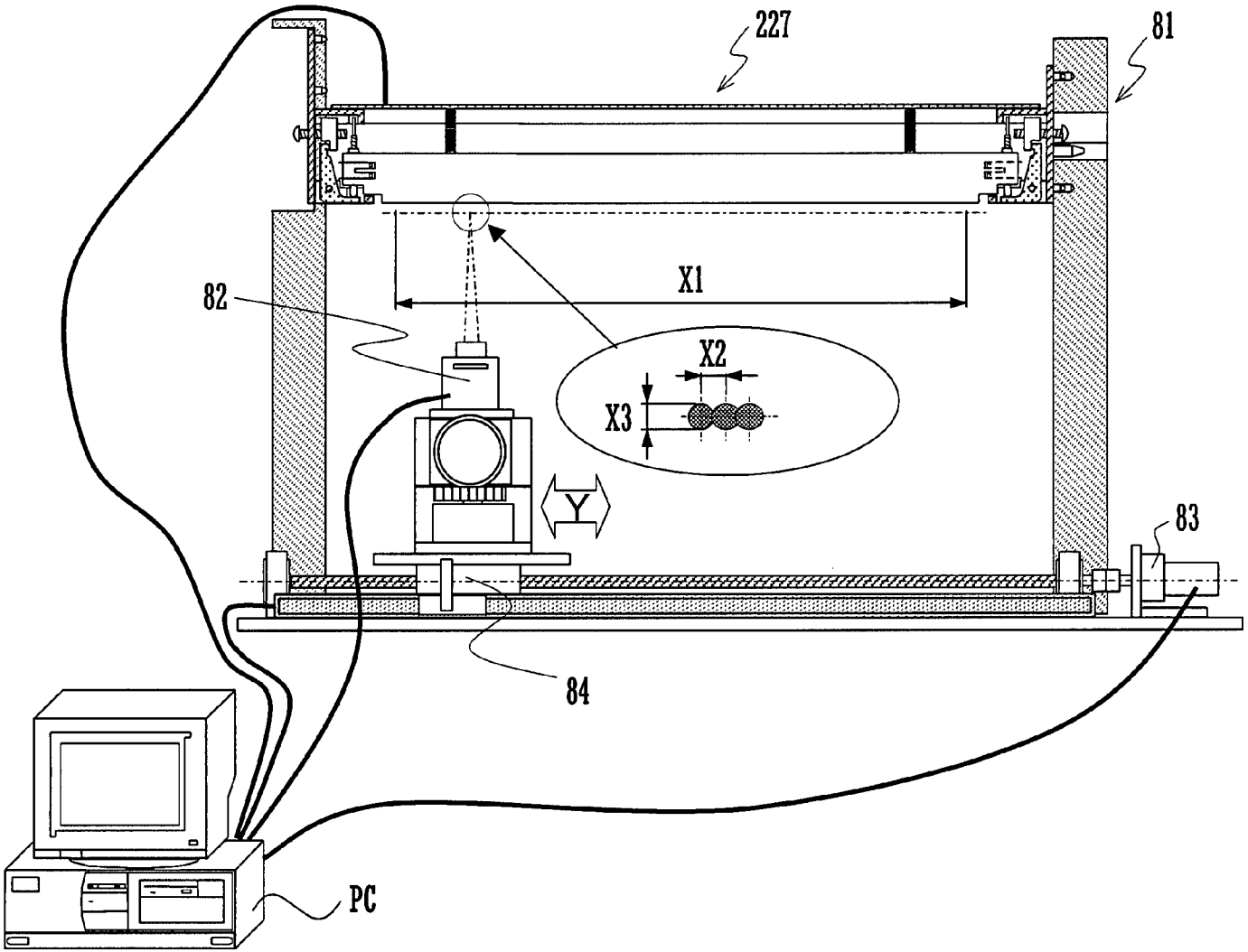
FIG. 9 is illustration of an exemplary focus adjustment jig for use in focus adjustment.

FIG. 9 illustrates a focus adjustment jig 81, which is an example of adjustment mechanism used at S2 and S3 of the flowchart of FIG. 8. The focus adjustment jig 81 is used for adjusting the position of the LED writing head 11 in the optical writing device 227 before the optical writing device 227 is mounted to the digital image forming apparatus 1. The configuration of the focus adjustment jig 81 is disclosed in Japan Patent Laid-open Publication No. 2003-173073, the entire contents of which are incorporated herein by reference. FIG. 9 schematically illustrates a state where the optical writing device 227 fitted to the focus adjustment jig 81 is under adjustment. As shown in FIG. 9, the focus adjustment jig 81 incorporates a CCD camera 82 therein. The CCD camera 82 is set on an automatic stage 84 connected to a motor 83. By driving the motor 83, the automatic stage 84 and the CCD camera 82 set thereon can be moved in the arrow Y direction (which corresponds to the primary scanning direction K). Thus, the CCD camera 82 successively captures an image on a line (focus position) which is indicated by a dashed dotted line in FIG. 9 and which corresponds to a surface of the photosensitive drum. The focus adjustment jig 81 is connected to a personal computer (PC), and the image captured by the CCD camera 82 is shown on the display of the personal computer (PC). The line indicated by the chain line is about 300 mm in the case of A3 width. When the resolution is 600 dpi, about 7000 light emitting elements are aligned on the line at a pitch of about 42.3 $\mu$m. Therefore, dots (about 60 $\mu$m in diameter) corresponding to the light emitting elements are marked on the line. While monitoring the magnified image displayed on the personal computer (PC), each of the adjusting screws 41, 51, and 61 is rotated so that the dots conform to the predetermined conditions, thereby performing focus adjustment. The use of the focus adjustment jig 81 enables accurate focus adjustment of the optical writing device 227.

Instead of displaying a magnified image of an image captured by the CCD camera 82 on the display for checking the focused state, computation may be performed based on data obtained by the CCD camera 82 to display the spot size, the amount of a positional deviation or the amount of adjustment by each of the adjusting screws 41, 51, and 61 numerically on the display. Alternatively, both of the image and the numeric values may be displayed either at a time or in a switched fashion. With such an arrangement, fluctuations of adjustment due to variations among individual operators and the like can be lessened as compared with visual adjustment, which enhances the efficiency of adjustment.

The optical writing device 227 of the above-described construction is mounted on a front frame 31 and a rear frame 32 of the digital image forming apparatus 1 at a predetermined position. At that time, if the frames 31 and 32 of the image forming apparatus 1 are deflected to some extent or the positional relationship therebetween is deviated to some extent, the connecting member 23, which is lower in rigidity than other parts, deforms in accordance with the deflection or deviation. However, the LED writing head 11 itself and the positioning members 45, 46, 55 and 56 formed at the first block 21 and second block 22 does not deform. Therefore, it is possible to properly position the LED writing head 11 relative to the photosensitive drum 222 supported by the front frame 31 and the rear frame 32.

Thus, in the case where the adjustment for focusing on the image carrier is made before the optical writing device 227 is mounted to the digital image forming apparatus 1, the position of the LED writing head 11 relative to the photosensitive drum 222 is unlikely to be deviated even after the optical writing device 227 is mounted to the image forming apparatus 1. Further, even if the position is deviated, it can be properly corrected.

Preferably, the optical writing device 227 is so mounted that the second block 22 is located on the trailing edge side (on the front frame 31 side) of the device 227 in the insertion direction for inserting the optical writing device 227 into the digital image forming apparatus 1. This is because the second block 22 is provided with the second adjustment member 53 and the third adjustment member 63 for changing the position of the LED writing head 11 in different directions. By so doing, even after the optical writing device 227 is mounted to the digital image forming apparatus 1, the adjusting screws 51 and 61 can be manipulated to move the second adjustment member 53 and the third adjustment member 63 if the front frame 31 is opened.

With the above-described construction, if focal shift in optical writing or oblique printing occurs, focus adjustment or inclination adjustment can be achieved even after the optical writing device is mounted. The first block 21 becomes located on the rear side of the digital image forming apparatus 1. However, if an arrangement is employed such that the adjusting screw 41, which is adapted to move the first adjustment member 43, is projected from a hole of the rear frame 32, the focus adjustment can be achieved with the optical writing device 227 kept mounted to the image forming apparatus 1 if the rear cabinet is detached.

As described above, the present invention provides the following advantages.

The support unit is mounted to a predetermined position with the first and second support members thereof supporting opposite ends of the writing head and connected to each other via the connecting member which is most easily deformable by an external force among the parts of the optical writing device because of its lowest bending rigidity, for example. Therefore, even when an external force is exerted on the optical writing device in mounting the optical writing device due to deflection of a frame for mounting the support unit or the like, such an external force can be absorbed by deformation of the connecting member which is most easily deformable among the parts of the optical writing device. Thus, it is possible to prevent damage to the writing head itself as well as to prevent the first and second support members from deforming thereby keeping proper positional relationship between the writing head and the exposure object.

The first support member and the second support member are each formed into a block using a resin having a high rigidity, whereas the connecting member is formed of a thin metal sheet which has a low rigidity and which is not susceptible to brittle fracture. With this feature, the rigidity of the first and the second support members is enhanced while the rigidity of the connecting member is lowered, thereby increasing the difference in rigidity between the first and the second support members and the connecting member while assuredly maintaining the strength of the support unit as a whole at a certain level.

The optical writing device, which includes the support unit comprising the first and second support members supporting opposite ends of the writing head and the connecting member which interconnects the first support member and the second support member and which is most easily deformable by an external force among the parts of the optical writing device, is used as an exposure device in an electrophotographic image forming apparatus. Therefore, when the size of the optical writing device does not fit in the size of a space for mounting the optical writing device, the connecting member can be deformed to prevent the writing head and the first and the second support members from being heavily influenced by an external force exerted by the image forming apparatus on the optical writing device.

Therefore, even if a slight structural defect is present in the image forming apparatus, it does not influence the image forming processing. Particularly, in the case where the optical writing device is mounted to the image forming apparatus after focus adjustment is made outside the image forming apparatus, the need for focus readjustment and the like due to deformation of the first support member or the second support member caused by a structural defect of the image forming apparatus can be eliminated. Thus, the focus adjustment made before the mounting of the optical writing device is effectively utilized.

Each of the first support member and the second support member is provided with a position adjustment member for adjusting the position of the writing head relative to the image carrier so that the first support member side and the second support member side have their respective independent structures. This feature allows the focus adjustment of the writing head or the adjustment of inclination of the writing line to be made using one of the position adjustment members separately provided at the respective support members. Therefore, the mechanism for adjusting the position of the writing head relative to the image carrier can be made compact.

Since the manipulation member used for adjusting the position of the writing head relative to the image carrier is exposed outside the support unit, the manipulation member can be easily manipulated even after the optical writing device is mounted to the image forming apparatus if only the cover of the apparatus is detached. Therefore, readjustment of the position of the optical writing head relative to the image carrier can be smoothly performed when it becomes necessary due to change of the positional relationship between the writing head and the image carrier caused by improper handling in transportation or installation of the apparatus or improper maintenance, for example.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. An optical writing device comprising:

a writing head including a plurality of light emitting portions aligned in an array for irradiating an exposure object with light, the writing head having opposite first and second ends;

a first support member supporting the first end of the writing head;

a second support member supporting the second end of the writing head; and a connecting member interconnecting the first support member and the second support member while maintaining a positional relationship between the first support member and the second support member, the connecting member being formed of a material which is more easily deformable than any one of the first support member, the second support member and the writing head.

2. The optical writing device in accordance with claim 1, wherein the connecting member further has a configuration which is more easily deformable than any one of the first support member, the second support member, and the writing head.

3. The optical writing device in accordance with claim 1, wherein the first support member and the second support member are formed of a resin material, while the connecting member formed of a thin metal sheet.

4. An image forming apparatus comprising:

an optical writing device, and an image carrier as an exposure object disposed as facing the optical writing device;

the optical writing device comprising:

a writing head including a plurality of light emitting portions aligned in an array for irradiating the exposure object with light, the writing head having opposite first and second ends, a first support member supporting the first end of the writing head, a second support member supporting the second end of the writing head, and a connecting member interconnecting the first support member and the second support member while maintaining a positional relationship between the first support member and the second support member, the connecting member being formed of a material which is more easily deformable than any one of the first support member, the second support member and the writing head while also having a configuration which is more easily deformable than any one of the first support member, the second support member, and the writing head.

5. The image forming apparatus in accordance with claim 4, wherein:

the first support member is provided with a first position adjustment member for moving the first end of the writing head toward and away from the image carrier, and the second support member is provided with a second position adjustment member for moving the second end of the writing head toward and away from the image carrier, the optical writing device further including, a third position adjustment member for displacing the second end of the writing head in a direction parallel to a sheet feeding direction.

6. The image forming apparatus in accordance with claim 5, wherein the first support member, the second support member, and the connecting member constitute a support unit supporting the writing head, the support unit further including manipulation members for use in position adjustment of the writing head by the first position adjustment member, the second position adjustment member, and the third position adjustment member, the manipulation members being exposed outside the support unit.

* * * * *